US009970136B2

(12) United States Patent
Inli

(10) Patent No.: US 9,970,136 B2
(45) Date of Patent: May 15, 2018

(54) APPARATUS AND METHOD FOR JOINING LOOPS OF A TUBULAR KNITTED ARTICLE

(71) Applicant: DA KONG ENTERPRISE CO., LTD., Changhua (TW)

(72) Inventor: Mustafa Inli, Istanbul (TR)

(73) Assignee: DA KONG ENTERPRISE CO., LTD., Changhua (TW)

( * ) Notice: Subject to any disclaimer, the term of this patent is extended or adjusted under 35 U.S.C. 154(b) by 175 days.

(21) Appl. No.: 15/054,337

(22) Filed: Feb. 26, 2016

(65) Prior Publication Data

US 2016/0258088 A1 Sep. 8, 2016

(30) Foreign Application Priority Data

Mar. 4, 2015 (TR) ..... 2015 02607

(51) Int. Cl.

| | |
|---|---|
| ***D04B 9/56*** | (2006.01) |
| ***D04B 9/40*** | (2006.01) |
| ***D04B 1/26*** | (2006.01) |
| ***D04B 15/02*** | (2006.01) |

(52) U.S. Cl.

CPC ..... *D04B 9/56* (2013.01); *D04B 1/26* (2013.01); *D04B 9/40* (2013.01); *D04B 15/02* (2013.01)

(58) Field of Classification Search

CPC ..... D04B 15/88; D04B 15/02; D04B 1/26; D04B 9/40; D04B 9/56

USPC ..... 66/147, 148

See application file for complete search history.

(56) References Cited

U.S. PATENT DOCUMENTS

| | | | | |
|---|---|---|---|---|
| 5,570,591 | A * | 11/1996 | Frullini | D04B 9/56 66/148 |
| 6,044,668 | A * | 4/2000 | Conti | D04B 9/56 66/148 |
| 6,826,930 | B2 * | 12/2004 | Frullini | D04B 9/40 66/148 |
| 7,882,711 | B2 * | 2/2011 | Bianchi | D04B 9/56 66/148 |
| 8,443,633 | B1 * | 5/2013 | Inli | D04B 1/108 66/148 |
| 9,273,422 | B2 * | 3/2016 | Inli | D05B 23/009 |
| 9,562,307 | B2 * | 2/2017 | Conti | D04B 9/40 |
| 2001/0039816 | A1 * | 11/2001 | Fujiwara | D04B 15/06 66/13 |
| 2004/0211226 | A1 * | 10/2004 | Frullini | D04B 9/40 66/147 |

* cited by examiner

*Primary Examiner* — Danny Worrell

(57) ABSTRACT

A loop joining apparatus is for joining loops of a tubular knitted article, and includes a reed unit and two loop holding units. The reed unit includes a first reed including a plurality of first reed teeth, and a second reed including a plurality of second reed teeth. The first and second reeds are pivotable relative to each other about a folding axis to transform between an expanded state and a stacked state. Each of the loop holding units holds at least one of two adjacent ones of the loops that are positioned closest to and symmetrical about the folding axis, to retain the at least one of the two adjacent ones of the loops on a corresponding one of the first and second reed teeth when the reed unit is transformed to the stacked state.

13 Claims, 13 Drawing Sheets

APPARATUS AND METHOD FOR JOINING LOOPS OF A TUBULAR KNITTED ARTICLE

CROSS-REFERENCE TO RELATED APPLICATION

This application claims priority of Turkish Patent Application No. 201502607, filed on Mar. 4, 2015.

FIELD

The disclosure relates to an apparatus and a method for joining loops of a tubular knitted article, and particularly for use in a stocking manufacturing machine for toe closure.

BACKGROUND

A tubular knitted article that has two opposite open ends, e.g., body of a stocking, is knitted using a yarn and a knitting machine that includes a cylindrical needle carrier and a plurality of needles. The needle carrier is rotatable about a central axis. The needles are angularly disposed on the needle carrier and spaced evenly apart, are co-rotatable with the needle carrier, and are movable in an axial direction relative to the needle carrier. As the needle carrier rotates, the needles alternately move upward and downward in the axial direction to knit the yarn and form loops that constitute the tubular knitted article.

After the knitting is completed, the tubular knitted article is transferred to a stitching apparatus from the knitting machine by using a transfer apparatus, as disclosed in U.S. Pat. No. 8,443,633. The stitching apparatus includes a loop joining apparatus and a sewing, needle, and is for closing one of the open ends so as to form a toe end of the stocking.

Referring to FIGS. 1 and 2, the loop joining apparatus includes a semi-circular first reed 150 and a semi-circular second reed 160 that is pivotally connected to the first reed 150 such that the first and second reeds 150, 160 are pivotable relative to each other about a folding axis 280. The first reed 150 includes a plurality of angularly spaced-apart first reed teeth 100. The second reed 160 includes a plurality of angularly spaced-apart second reed teeth 250. The first and second reed teeth 100, 250 are for extending through uppermost loops 2 of the tubular knitted article, respectively.

The uppermost loops 2 are divided into a first group and a second group with respect to the folding axis 280. The first group includes a plurality of loops 130 that are respectively placed on the first reed teeth 100. The second group includes a plurality of loops 140 that are respectively placed on the second reed teeth 250. Two of the loops 130 of the first group, which are defined as first and last loops 130*a*, 130*b*, respectively correspond in position to opposite ends of the first reed 150 and are located adjacent to the folding axis 280. Two of the loops 140 of the second group, which are defined as first and last loops 140*a*, 140*b*, respectively correspond in position to opposite ends of the second reed 160 and are respectively located adjacent to the first and last loops 130*a*, 130*b* of the first group.

With further reference to FIG. 3, the first and second reeds 150, 160 are operable to pivot relative to each other about the folding axis 280 between an expanded state and a stacked state. In the expanded state, the first and second reeds 150, 160 are disposed side by side and symmetrical about the folding axis 280. In the stacked state, the first and second reeds 150, 160 are stacked one above the other in the axial direction, and the second reed teeth 250 respectively mate with the first reed teeth 100, such that each of the loops 140 of the second group is operable to join a respective one of the loops 130 of the first group, and that a sewing needle 700 can be used to stitch the joined loops together to thereby form the toe end of the stocking.

However, since the first and last loops 130*a*, 130*b* of the first group and the first and last loops 140*a*, 140*b* of the second group are located adjacent to the folding axis 280, they may slide and fall off from the corresponding reed teeth 100, 250 when the first and second reeds 150, 160 are transformed from the expanded state to the stacked state, and may undesirably ladder the stocking.

In order to prevent the first and last loops 130*a*, 130*b*, 140*a*, 140*b* of each of the first and second groups from sliding and falling off during such transformation, surfaces of the corresponding reed teeth 100, 250 may be roughened. By this way, the first and last loops 130*a*, 130*b*, 140*a*, 140*b* of each of the first and second groups may be retained on the corresponding reed teeth 100, 250 due to friction when the first and second reeds 150, 160 are transformed from the expanded state to the stacked state. However, the first and last loops 130*a*, 130*b*, 140*a*, 140*b* of the first and second groups may become fluffy due to contact with the corresponding reed teeth 100, 250 that are roughened, and may adversely affect the aesthetic appearance of the stocking.

SUMMARY

Therefore, an object of the disclosure is to provide a loop joining apparatus that can alleviate at least one of the drawbacks of the prior art.

According to one aspect of the disclosure, the loop joining apparatus is adapted for joining loops of an open end of a tubular knitted article to close the open end. The loops of the open end surround a central axis. The loop joining apparatus includes a reed unit and two loop holding units.

The reed unit includes a first reed that includes a plurality of first reed teeth, and a second reed that is pivotally connected to the first reed and that includes a plurality of second reed teeth. The first and second reeds are pivotable relative to each other about a folding axis, which is transverse to the central axis, to transform between an expanded state and a stacked state.

When the reed unit is in the expanded state, the reed unit and the folding axis intersect at two line intersects, the first and second reeds are disposed side by side and symmetrical about the folding axis, and the first and second reed teeth surround the central axis and are adapted for respectively extending through the loops. When the reed unit is in the stacked state, the first and second reeds are stacked together, and the first reed teeth respectively mate with the second reed teeth.

The loop holding units are respectively disposed adjacent to the line intersects. Each of the loop holding units is adapted to hold at least one of two adjacent ones of the loops that are positioned closest to and symmetrical about a corresponding one of the line intersects, so as to retain the at least one of the two adjacent ones of the loops on a corresponding one of the first and second reed teeth when the reed unit is transformed from the expanded state to the stacked state.

Another object of the disclosure is to provide a method for joining loops of an open end of a tubular knitted article that can alleviate at least one of the drawbacks of the prior art.

According to another aspect of the disclosure, the method includes the steps of:

(1) extending respectively first and second reed teeth of first and second reeds of a reed unit through the loops when the reed unit is in an expanded state;

(2) holding at least one of two adjacent ones of the loops that are positioned closest to and symmetrical about a corresponding one of two line intersects of the reed unit and a folding axis, about which the first and second reeds are pivotable relative to each other, so as to retain the at least one of the two adjacent ones of the loops, which corresponds to the corresponding one of the line intersects, on a corresponding one of the first and second reed teeth; and (3) transforming the reed unit from the expanded state to a stacked state, so that the first and second reeds are stacked together, and the first reed teeth respectively mate with the second reed teeth.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
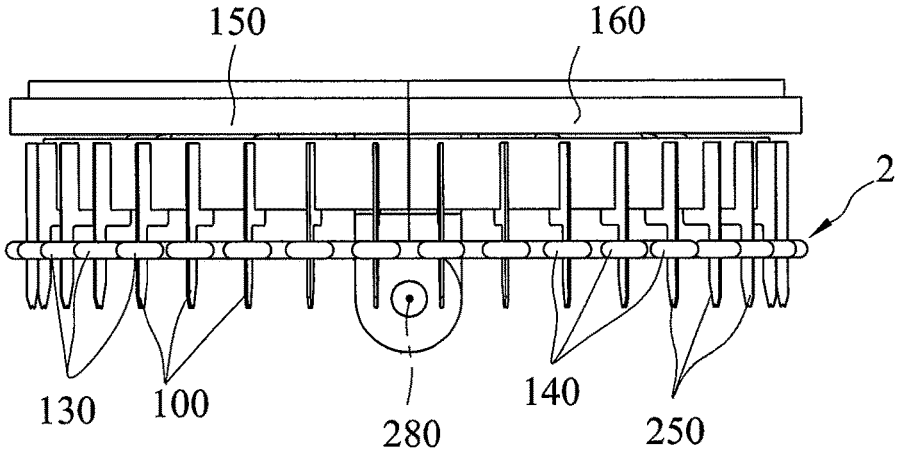
FIG.1 PRIOR ART
FIG. 1 is a side view illustrating a plurality of loops of a tubular knitted article and a conventional loop joining apparatus.
Figure 2:
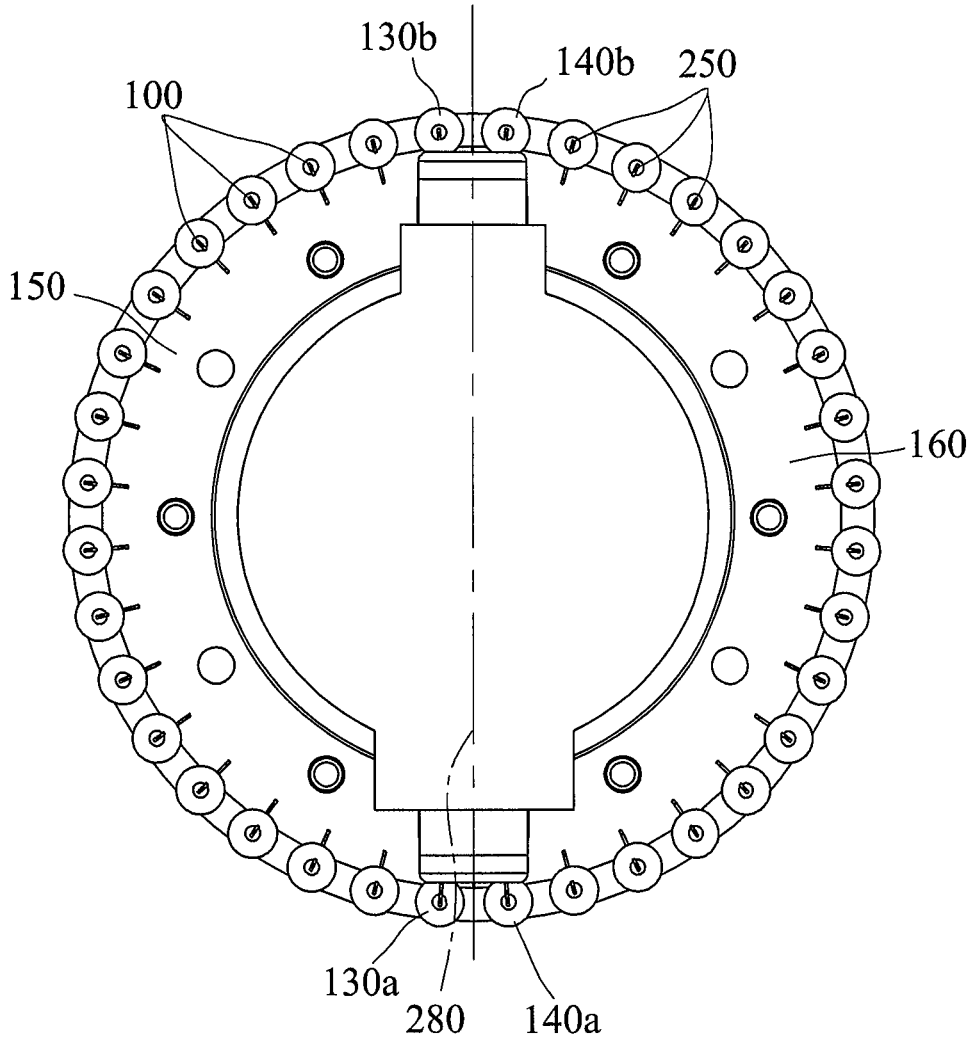
FIG.2 PRIOR ART
FIG. 2 is a bottom view illustrating the loops and the conventional loop joining apparatus.
Figure 3:
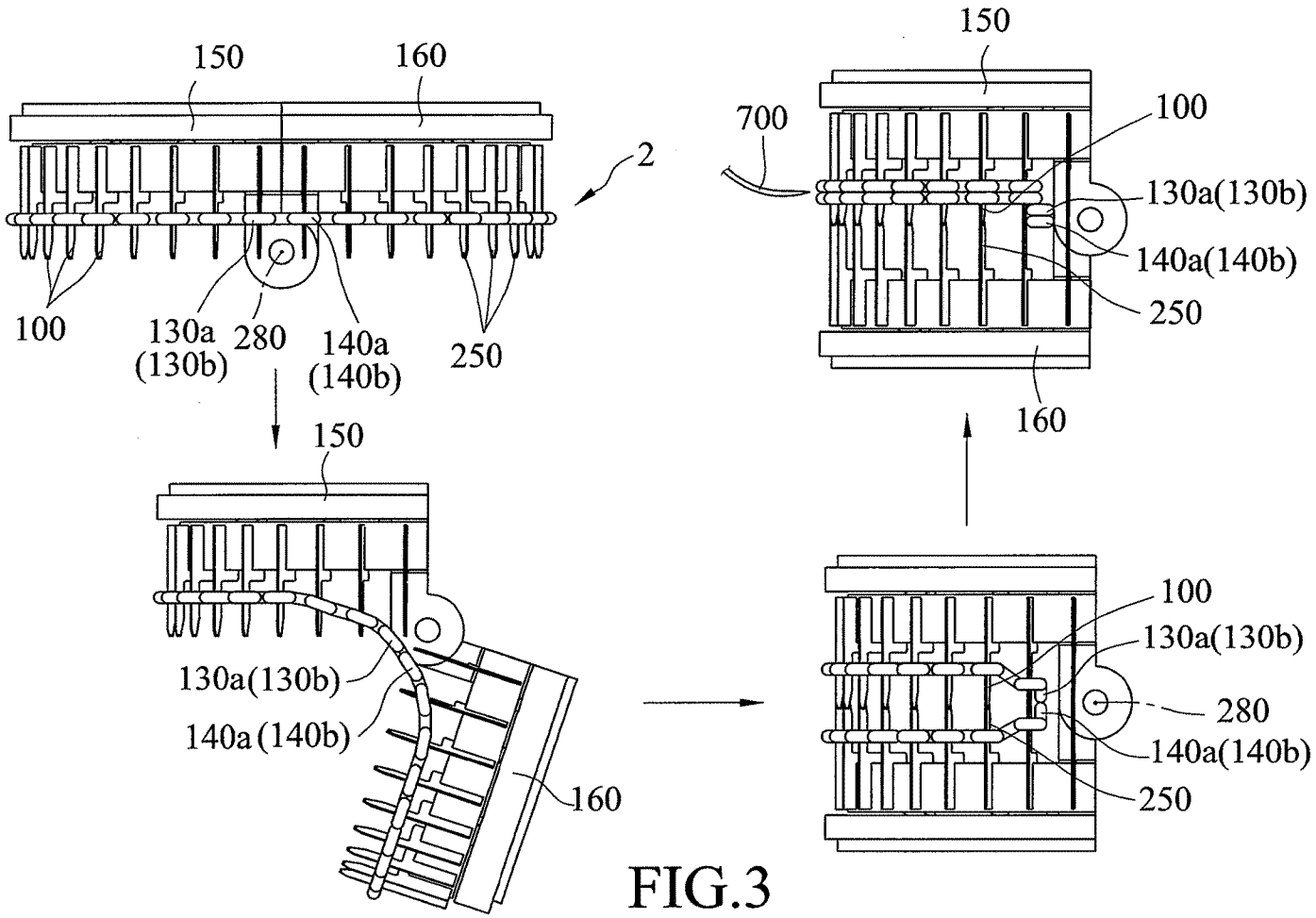
FIG.3 PRIOR ART
FIG. 3 is a schematic view illustrating movement of the loops as a reed unit of the conventional loop joining apparatus is transformed from an expanded state to a stacked state.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
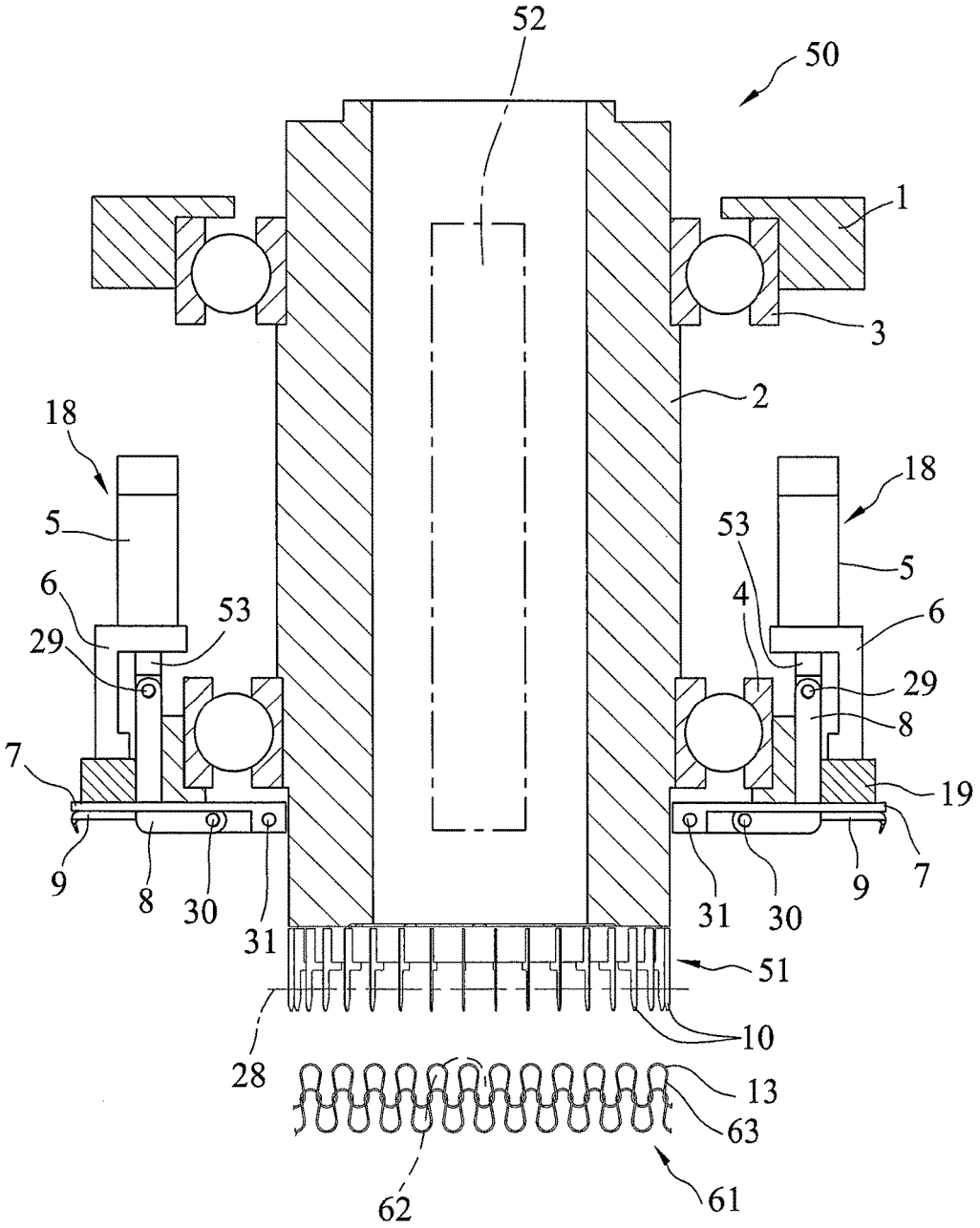
FIG. 4 is a schematic partly sectional view illustrating an embodiment of a loop joining apparatus according to the disclosure and a plurality of loops of a tubular knitted article.
Figure 5:
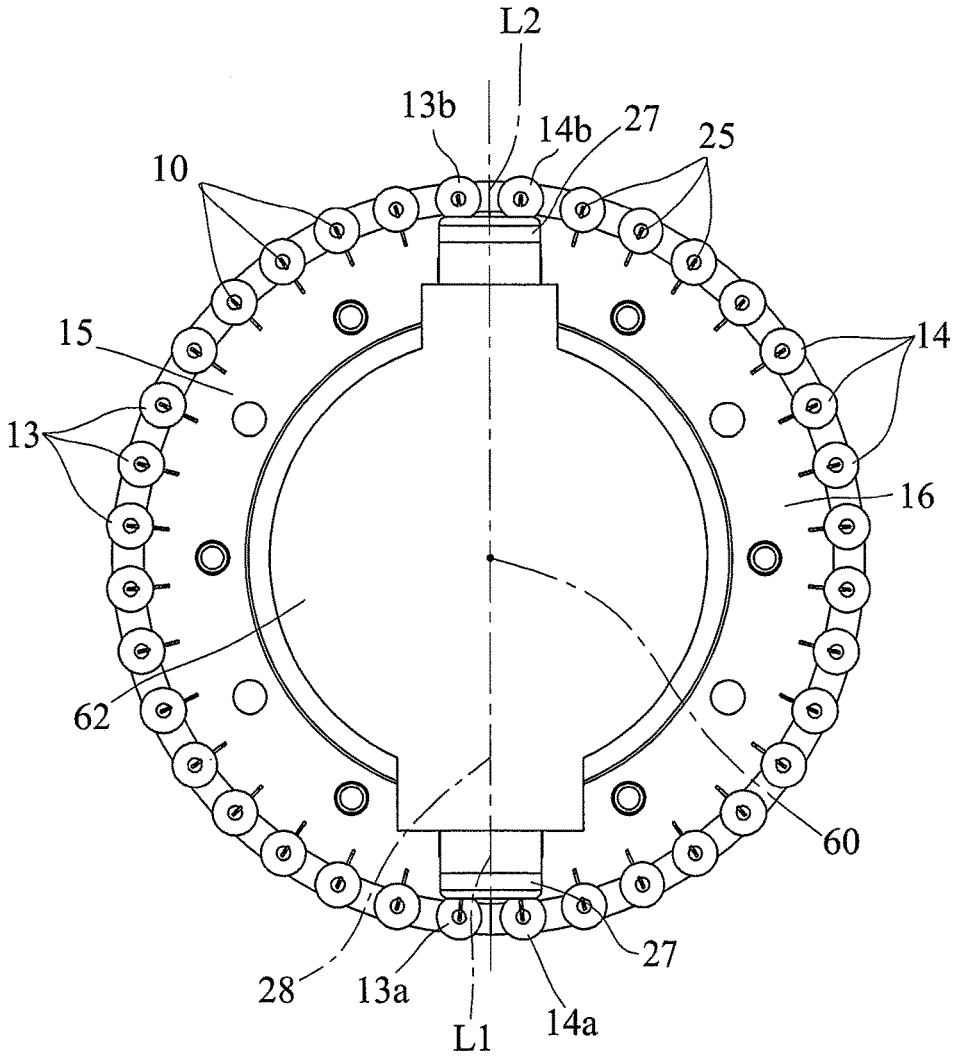
FIG. 5 is a bottom view illustrating a reed unit of the embodiment and the loops of the tubular knitted article.
Figure 6:
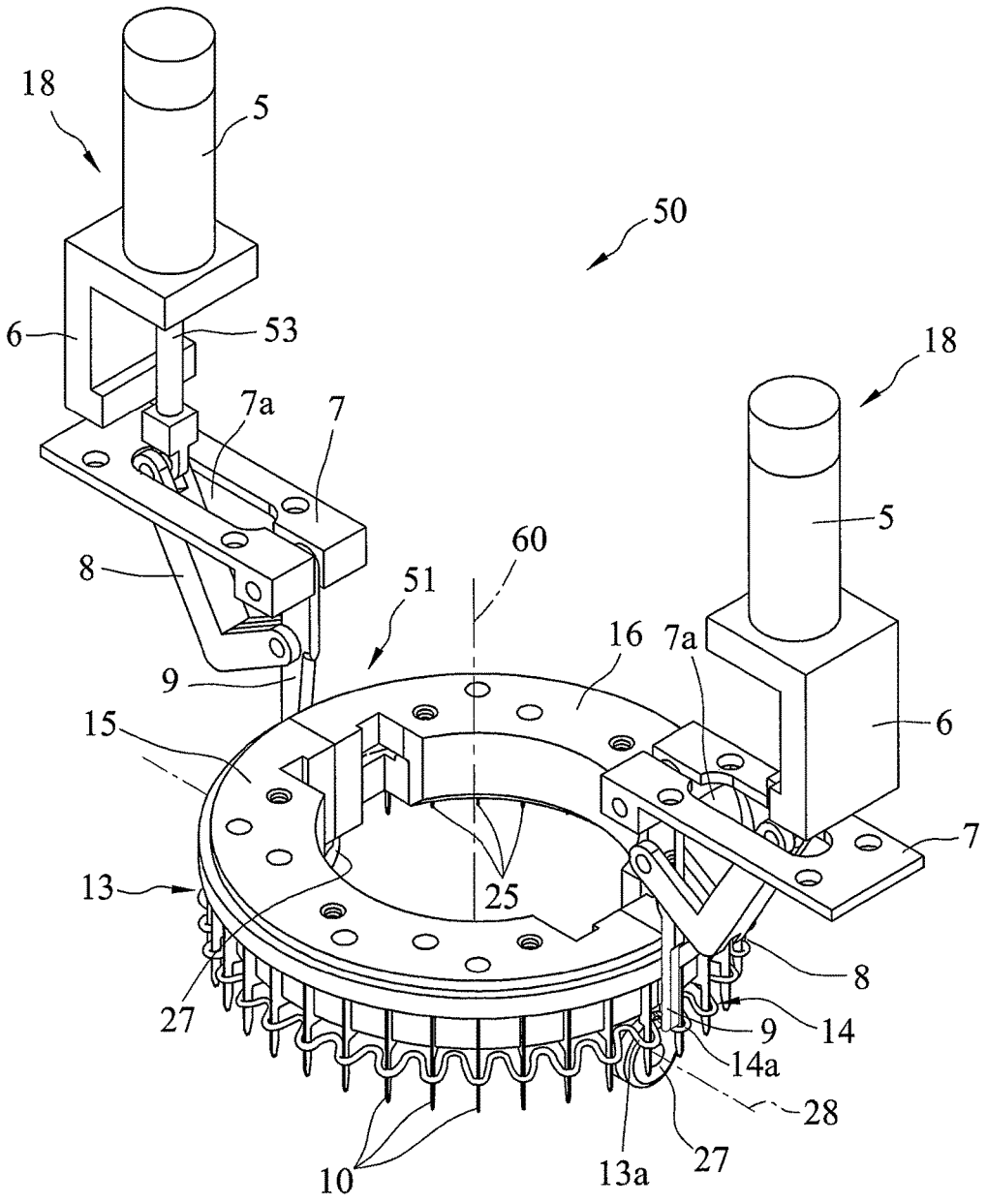
FIG. 6 is a perspective view of the embodiment, illustrating relative positions of the reed unit and two loop holding units.
Figure 7:
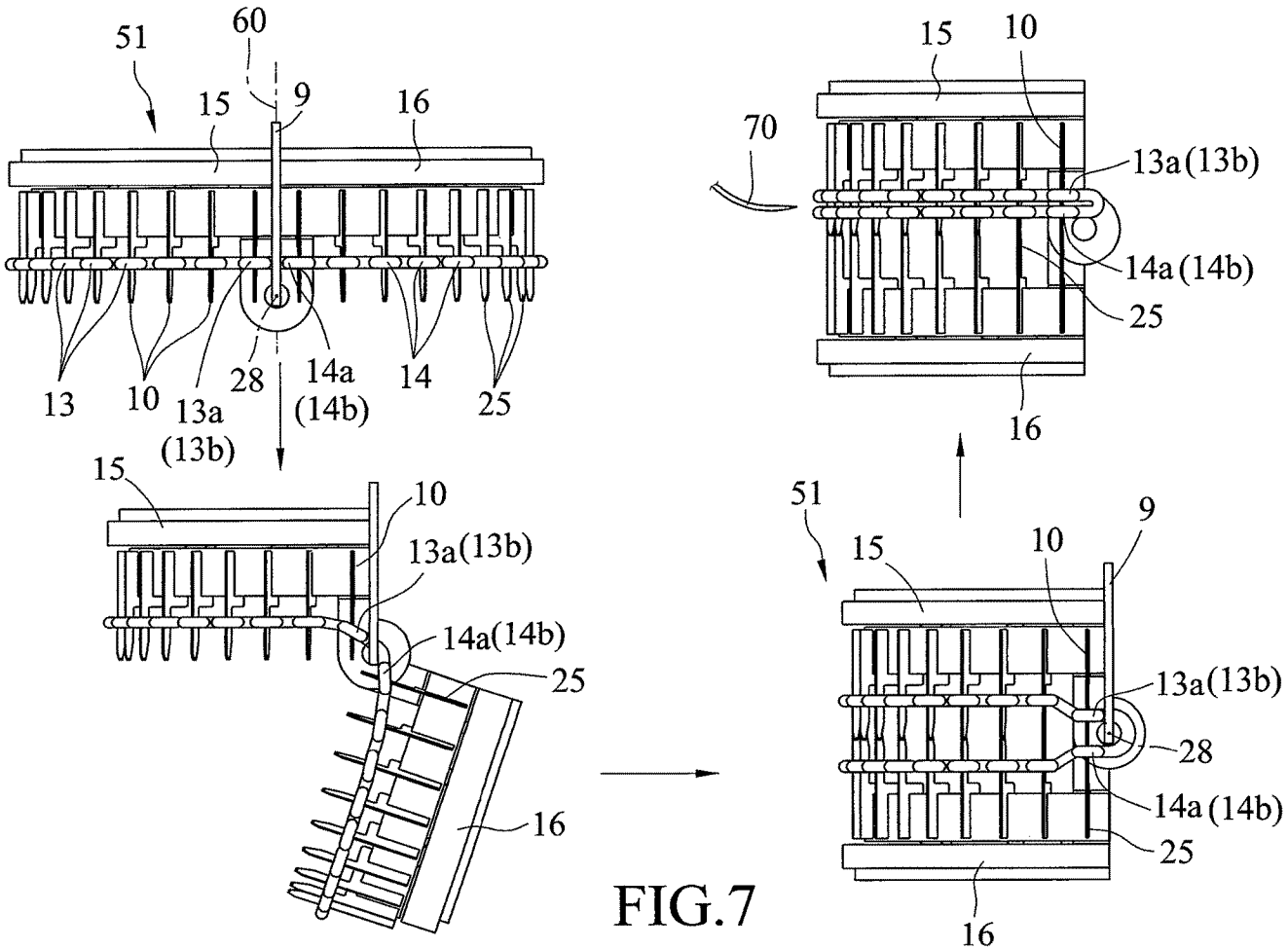
FIG. 7 is a schematic view illustrating movement of the loops as the reed unit of the embodiment is transformed from an expanded state to a stacked state.

Referring to FIGS. 4 to 6, the embodiment of a loop joining apparatus 50 according to the present disclosure is adapted to use in a stocking manufacturing system. The stocking manufacturing system includes an upper support 1, a lower support 19, a knitted device (not shown), a transfer device (not shown), and a stitching device connected to the lower support 19. The stitching device includes the loop joining apparatus 50 and a sewing needle 70 (see FIG. 7).

The loop joining apparatus 50 is adapted for joining loops of an open end 62 of a tubular knitted article 61 to close the open end 62. The tubular knitted article 61 is, for example but not limited to, a body of a stocking. The loops of the open end 62 of the tubular knitted article 61, i.e., uppermost loops 63 of the tubular knitted article 61, surround a central axis 60.

The loop joining apparatus 50 includes a sewing cylinder 2, an actuating unit 52, a reed unit 51, and two loop holding units 18.

The sewing cylinder 2 is disposed above and rotatable relative to the reed unit 51. The sewing cylinder 2 is connected to the upper support 1 by virtue of an upper bearing 3 (see FIG. 4) and is rotatable relative to the upper support 1. The sewing cylinder 2 is connected to the lower support 19 by virtue of a lower bearing 4 and is rotatable relative to the lower support 19 and the loop holding units 18. The lower bearing 4 is, for example but not limited to, a roller bearing.

The actuating unit 52 is disposed in the sewing cylinder 2, and is operable to drive the reed unit 51 to transform between an expanded state and a stacked state. Since the actuating unit 52 is disclosed in Taiwanese Patent No. M476149 and is not of the essence of the present disclosure, further details are not provided herein for the sake of brevity.

The reed unit 51 is annular in shape, and includes a semi-annular first reed 15 and a semi-annular second reed 16 that is pivotally connected to the first reed 15 by virtue of two spaced-apart pivot members 27. The first reed 15 includes a plurality of first reed teeth 10. The second reed 16 includes a plurality of second reed teeth 25. The first and second reeds 15, 16 are pivotable relative to each other about a folding axis 28, which is transverse to the central axis 60, to transform the reed unit 51 between the expanded state and the stacked state.

When the reed unit 51 is in the expanded state, the reed unit 51 and the folding axis 28 intersect at two line intersects (L1, L2) (see FIG. 5), the first and second reeds 15, 16 are disposed side by side and symmetrical about the folding axis 28, and the first and second reed teeth 10, 25 surround the central axis 60 and respectively extend through the uppermost loops 63 of the tubular knitted article 61. When the reed unit 51 is in the stacked state, the first and second reeds 15, 16 are stacked together, and the first reed teeth 10 respectively mate with the second reed teeth 25.

The uppermost loops 63 are divided into a first group and a second group with respect to the folding axis 28. The first group includes a plurality of loops 13 that are respectively placed on the first reed teeth 10. The second group includes a plurality of loops 14 that are respectively placed on the second reed teeth 25. Two of the loops 13 of the first group, which are defined as first and last loops 13*a*, 13*b*, are located adjacent to the folding axis 28. Two of the loops 14 of the second group, which are defined as first and last loops 14*a*, 14*b*, are respectively located adjacent to the first and last loops 13*a*, 13*b* of the first group.

In this embodiment, the second reed 16 is driven by the actuating unit 52 to pivot relative to the first reed 15 about the folding axis 28 when the reed unit 51 is transformed from the expanded state to the stacked state. When the reed unit 51 is in the stacked state, the transfer device joins the loops 14 of the second group with the loops 13 of the first group, then the sewing cylinder 2 is rotated so as to permit the loops 13 of the first group and the loops 14 of the second group to be sewn together by virtue of the sewing needle 70 (see FIG. 7).

In certain embodiments, the first reed 15 is driven by the actuating unit 52 to pivot relative to the second reed 16 about the folding axis 28 when the reed unit 51 is transformed from the expanded state to the stacked state. In certain embodiments, the first and second reeds 15, 16 are driven by the actuating unit 52 to pivot toward each other about the folding axis 28 to transform from the expanded state to the stacked state.

Referring to FIGS. 4, 5, 6, and 11, the loop holding units 18 are aligned along the folding axis 28 and are respectively disposed adjacent to the line intersects (L1, L2). Each of the loop holding units 18 includes a mounting seat 6, a driving member 5, a stationary platform 7, a holding member 9, and an L-shaped linking member 8.

Figure 8:
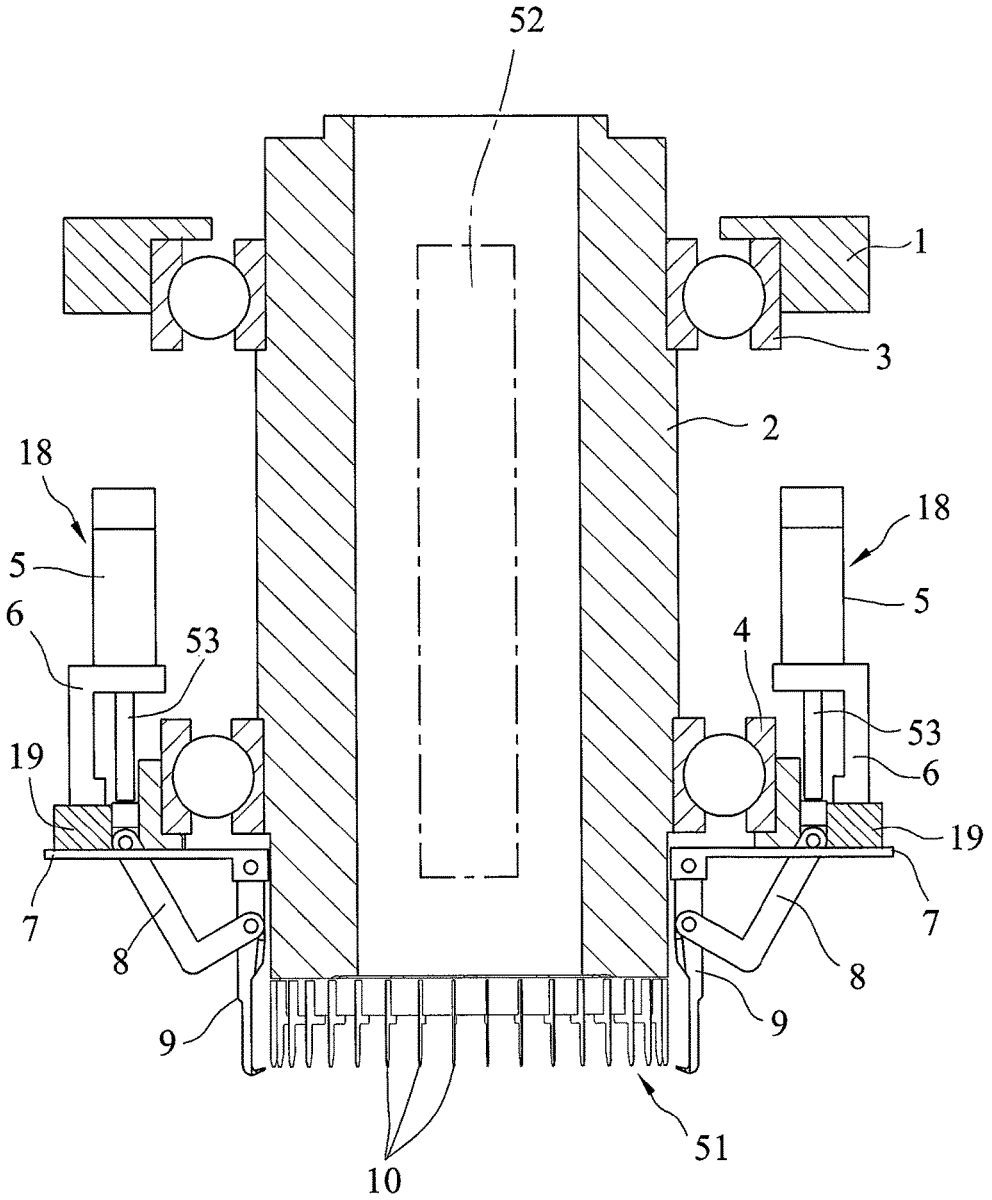
FIG. 8 is a view similar to FIG. 4, but illustrating the loop holding units of the embodiment each at a holding position.
Figure 9:
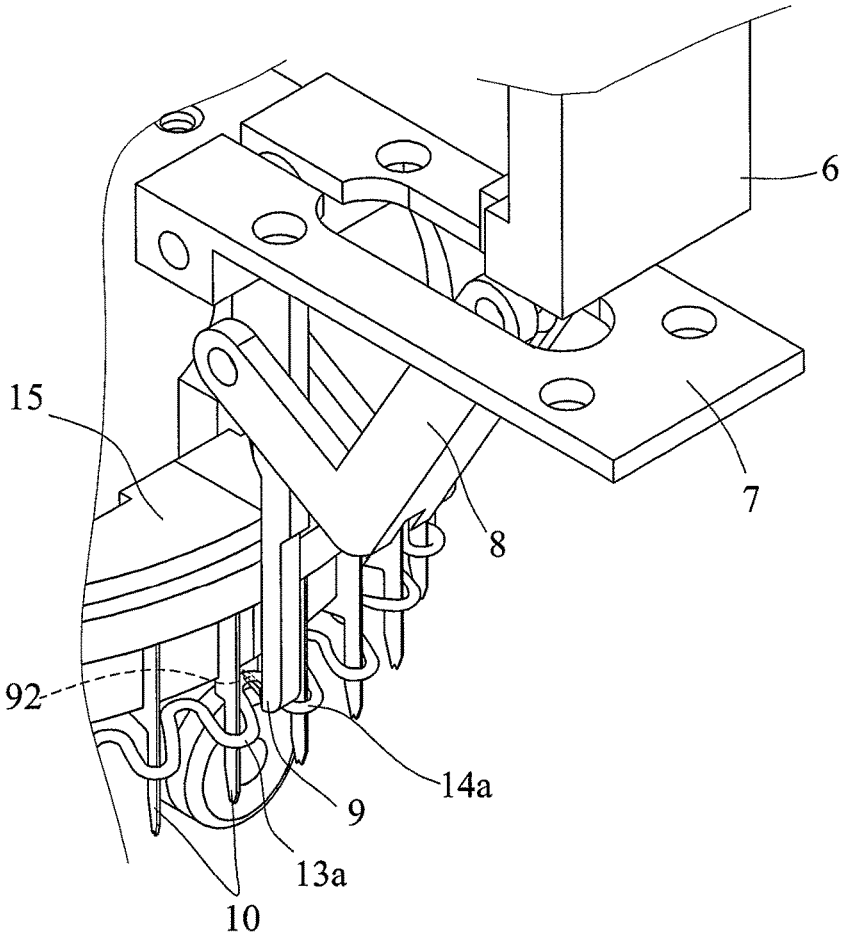
FIG. 9 is an enlarged fragmentary perspective view illustrating a loop holding member of one of the loop holding units of the embodiment at the holding position.
Figure 10:
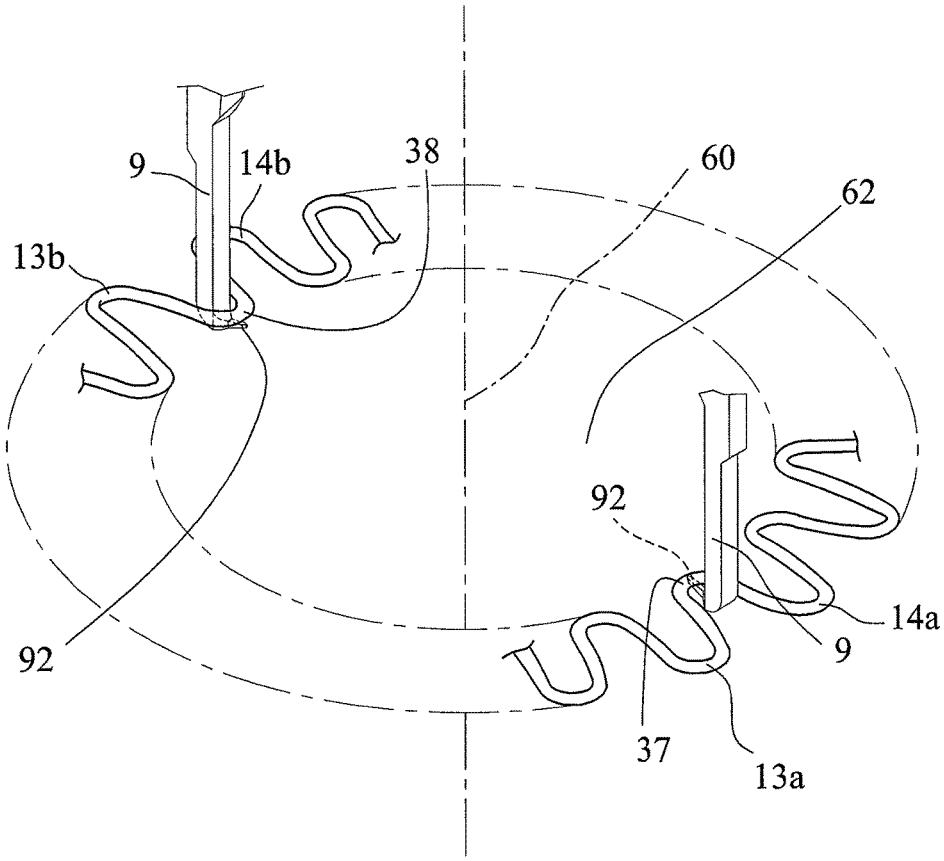
FIG. 10 is a schematic view illustrating that each of the loop holding members of the embodiment is at the holding position.
Figure 11:
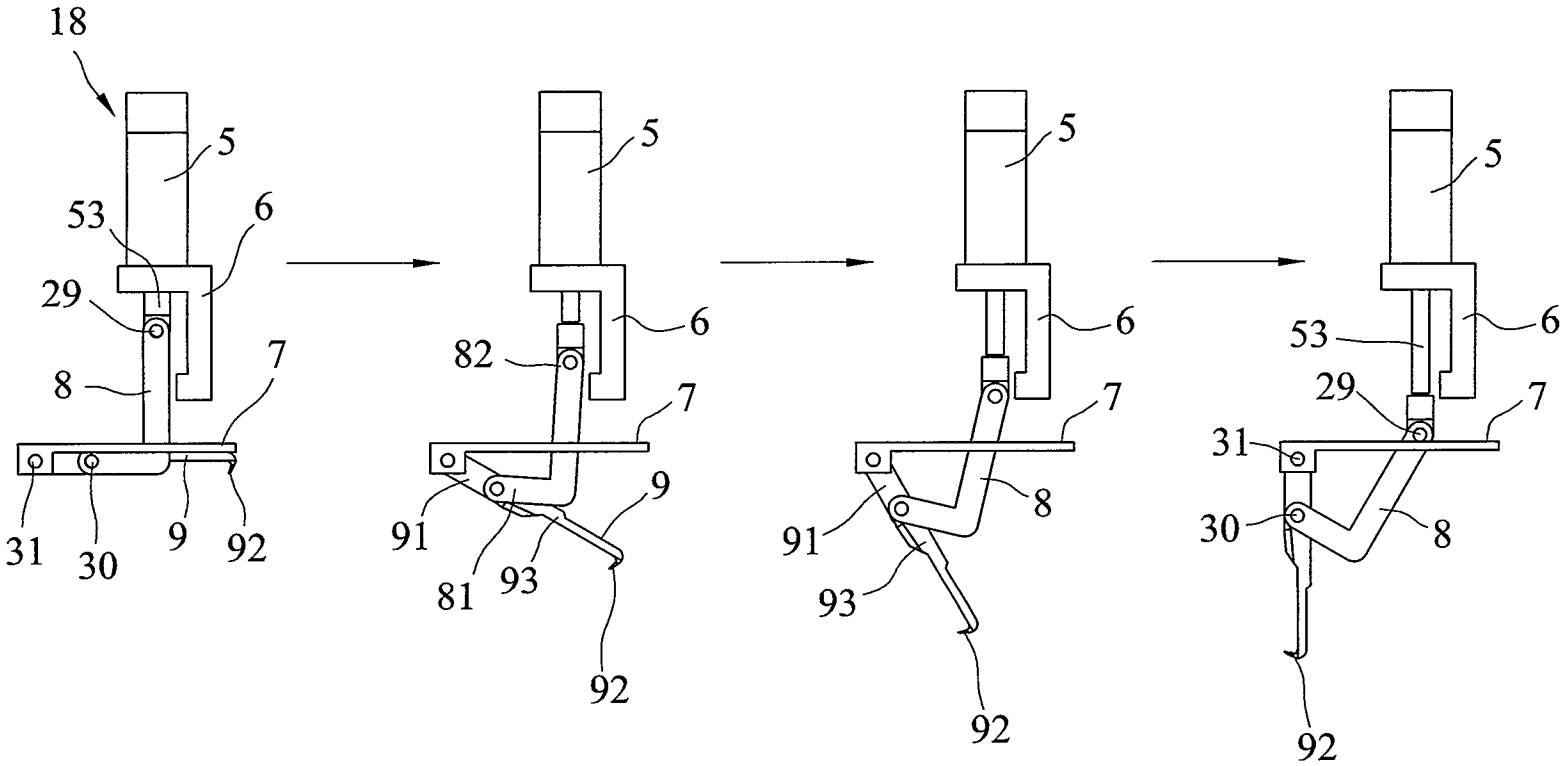
FIG. 11 is a schematic view of the embodiment, illustrating transformation of one of the loop holding members from a non-holding position to the holding position.

Since the structures of the loop holding units 18 are identical to each other, only one of the loop holding unit 18 is described below for the sake of brevity. The mounting seat 6 is fixedly connected to the lower support 19. The driving member 5 is mounted to the mounting seat 6, and includes a drive shaft 53. The driving member 5, e.g., a hydraulic cylinder or a pneumatic cylinder, is for driving movement of the holding member 9. The stationary platform 7 is connected to the lower support 19, is disposed under the driving member 5, and is formed with a slot 7*a* that extends vertically therethrough. The holding member 9 is disposed under the stationary platform 7, and has a pivot end portion 91 (see FIG. 11) that is pivoted to the stationary platform 7 via a first pin 31, a retaining end portion 92 (see FIG. 11) that is opposite to the pivot end portion 91, and a middle portion 93 (see FIG. 11) that interconnects the pivot end portion 91 and the retaining end portion 92. In this embodiment, the retaining end portion 92 is configured as a hook. The linking member 8 extends movably through the slot 7*a* of the stationary platform 7, and has a first end 81 (see FIG. 11) that is pivoted to the middle portion 93 of the holding member 9 via a second pin 30, and a second end 82 (see FIG. 11) that is opposite to the first end 81 and that is pivoted to the drive shaft 53 of the driving member 5 via a third pin 29. By this way, the driving member 5 is operable to move the holding member 9 between a holding position (see FIG. 8) and a non-holding position (see FIG. 4) through the linking member 8.

Referring to FIGS. 7, 9, 10, and 11, in greater detail, when the holding members 9 are each at the holding position, the retaining end portion 92 of the holding member 9 of one of the loop holding units 18 holds an interconnecting section 37 (see FIG. 10) that interconnects the first loops 13*a*, 14*a* of the first and second groups, and the retaining end portion 92 of the holding member 9 of the other one of the loop holding units 18 holds an interconnecting section 38 that interconnects the last loops 13*b*, 14*b* of the first and second groups, such that the first loops 13*a*, 14*a* and the last loops 13*b*, 14*b* are respectively retained on the corresponding first and second reed teeth 10, 25 when the reed unit 51 is transformed from the expanded state to the stacked state. When the holding members 9 are each at the non-holding position, the retaining end portion 92 of each of the holding members 9 is spaced apart from the reed unit 51, and releases a corresponding one of the interconnecting sections 37, 38.

During operation, the holding member 9 of each of the loop holding units 18 is driven by a corresponding one of the driving members 5 to transform from the non-holding position to the holding position when the reed unit 51 is in the expanded state. As the reed unit 51 is transformed from the expanded state to the stacked state, the holding members 9 retain the first loops 13*a*, 14*a* and the last loops 13*b*, 14*b* on the corresponding first and second reed teeth 10, 25 by respectively holding the interconnecting sections 37, 38. After the reed unit 51 is transformed to the stacked state, the holding member 9 of each of the loop holding units 18 is then driven by a corresponding one of the driving members 5 to move back to the non-holding position.

Since the first reed 15 is stacked above the second reed 16 when the reed unit 51 is in the stacked state, the first and last loops 13*a*, 13*b* of the first group may more easily fall off comparing with the first and last loops 14*a*, 14*b* of the second group when the reed unit 51 is transformed. Therefore, in certain embodiments, the holding member 9 of one of the loop holding units 18 may hold the first loop 13*a* of the first group, and the holding member 9 of the other one of the loop holding units 18 may hold the last loop 13*b* of the first group, so as to retain the first and last loops 13*a*, 13*b* of the first group on the corresponding first reed teeth 10.

Figure 12:
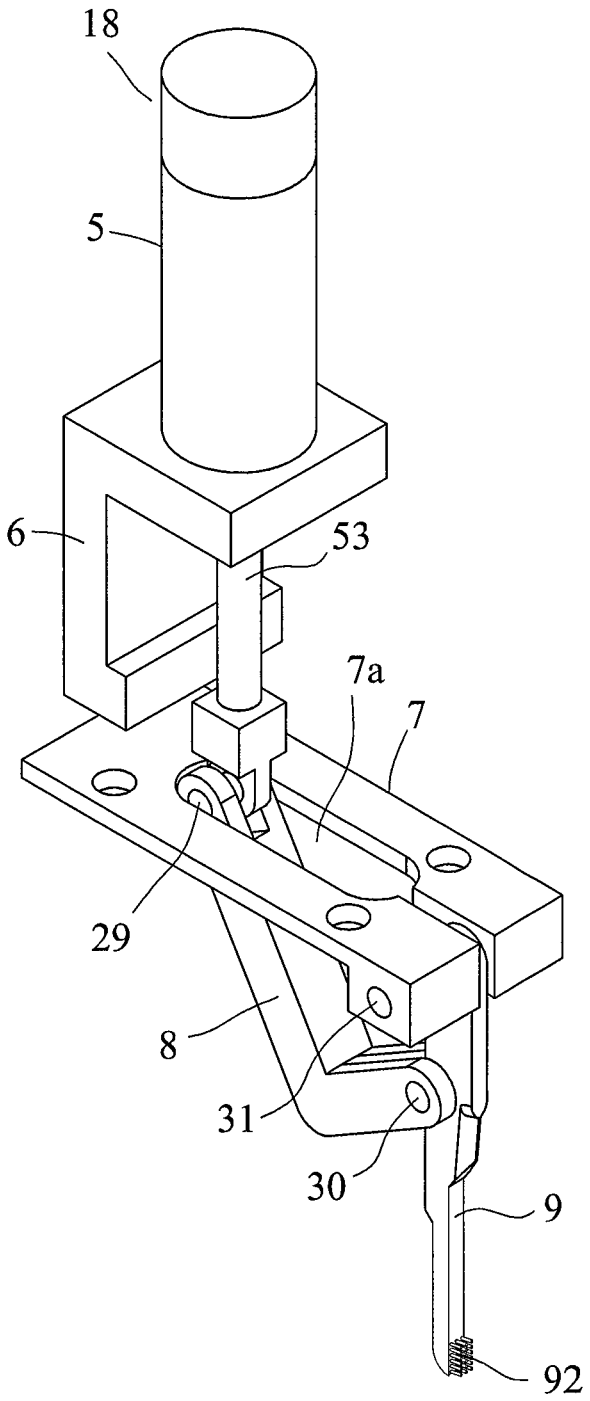
FIG. 12 is a perspective view illustrating a modification of the loop holding members of the embodiment.

Referring to FIG. 12, in a modification of the embodiment, the retaining end portion 92 of the holding member 9 of each of the loop holding units 18 is configured as a brush that presses against the corresponding one of the interconnecting sections 37, 38 (see FIG. 10) when the reed unit 51 is transformed from the expanded state to the stacked state.

Figure 13:
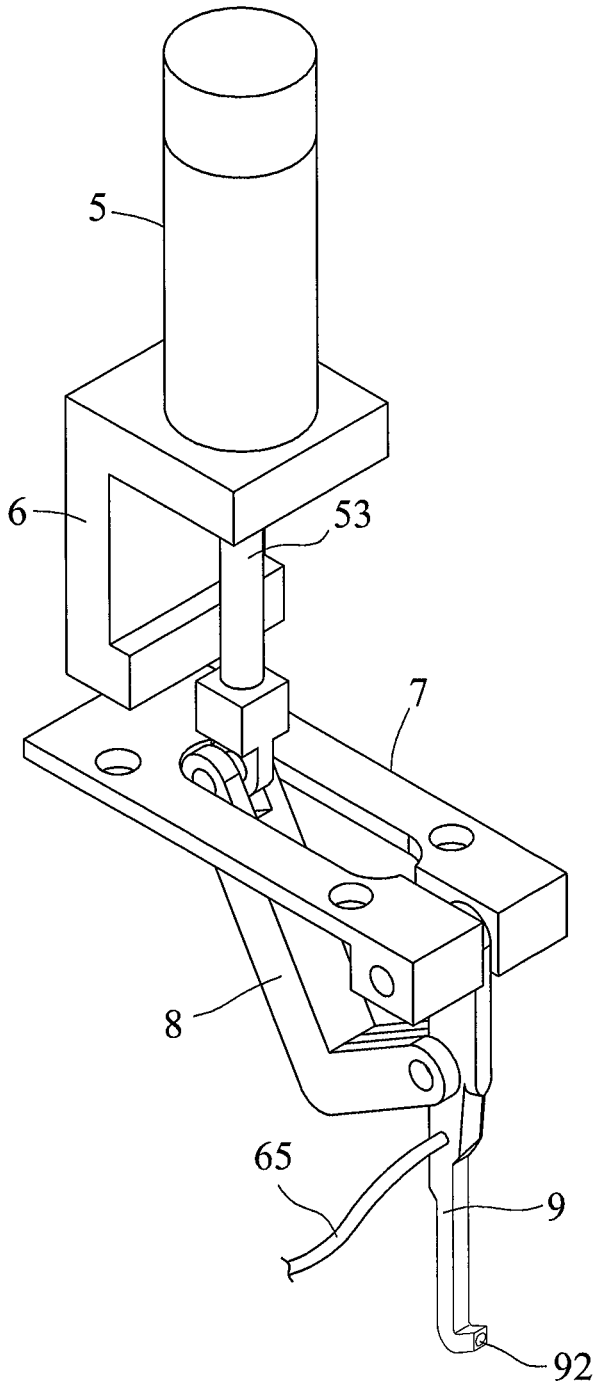
FIG. 13 is a perspective view illustrating another modification of the loop holding members of the embodiment.

Referring to FIG. 13, in another modification of the embodiment, the retaining end portion 92 of the holding member 9 of each of the loop holding units 18 is configured as an air nozzle that is connected to an air-delivering tube 65 of an air supply device (not shown). The air supply device is operable to supply air that blows out from the air nozzle toward the corresponding one of the interconnecting sections 37, 38, such that the first and last loops 13*a*, 13*b* of the first group and the first and last loops 14*a*, 14*b* of the second group respectively press against the corresponding first reed teeth 10 and the corresponding second reed teeth 25 when the reed unit 51 is transformed from the expanded state to the stacked state.

An embodiment of a method for joining the loops of the open end 62 of the tubular knitted article 61 includes the steps of:

(1) extending respectively the first and second reed teeth 10, 25 of the first and second reeds 15, 16 of the reed unit 51 through the uppermost loops 63 when the reed unit 51 is in the expanded state;

(2) holding at least one of two adjacent ones of the uppermost loops 63 that are positioned closest to and symmetrical about a corresponding one of the line intersects (L1, L2), i.e., the first loops 13*a*, 14*a* of the first and second groups that correspond to the line intersect (L1), and the last loops 13*b*, 14*b* of the first and second groups that correspond to the line intersect (L2) in FIG. 5, so as to retain the at least one of the two adjacent ones of the uppermost loops 63, which corresponds to the corresponding one of the line intersects (L1, L2), on a corresponding one of the first and second reed teeth 10, 25; and (3) transforming the reed unit 51 from the expanded state to the stacked state, so that the first and second reeds 15, 16 are stacked together, and the first reed teeth 10 respectively mate with the second reed teeth 25.

In certain embodiments, in step (2), the interconnecting section 37 that interconnects the first loops 13*a*, 14*a* of the first and second groups, and the interconnecting section 38 that interconnects the last loops 13*b*, 14*b* of the first and second groups are held, so as to retain the first and last loops 13*a*, 13*b* of the first group and the first and last loops 14*a*, 14*b* of the second group respectively on the corresponding ones of the first and second reed teeth 10, 25.

In certain embodiments, in step (2), for each of the line intersects (L1, L2), a selected one of the two adjacent ones of the uppermost loops 63, which extends into a corresponding one of the first reed teeth 10, is held and retained on the corresponding one of the first reed teeth 10. That is, the first and last loops 13*a*, 13*b* of the first group are retained on the corresponding first reed teeth 10.

To sum up, by virtue of the loop holding units 18, the first and last loops 13*a*, 13*b* of the first group and the first and last loops 14*a*, 14*b* of the second group are respectively retained on the corresponding first reed teeth 10 and the corresponding second reed teeth 25 when the reed unit 51 is transformed from the expanded state to the stacked state, thereby effectively preventing the first and last loops 13*a*, 13*b*, 14*a*, 14*b* from falling off the reed unit 51.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A loop joining apparatus for joining loops of an open end of a tubular knitted article to close the open end, the loops of the open end surrounding a central axis, said loop joining apparatus comprising:

a reed unit including a first reed that includes a plurality of first reed teeth, and a second reed that is pivotally connected to said first reed and that includes a plurality of second reed teeth, said first and second reeds being pivotable relative to each other about a folding axis which is transverse to the central axis, to transform said reed unit between an expanded state and a stacked state; and two loop holding units aligned along the folding axis and disposed respectively adjacent to two line intersects of the folding axis and said reed unit;

wherein:

when said reed unit is in the expanded state, said first and second reeds are disposed side by side and symmetrical about the folding axis, and said first and second reed teeth surround the central axis and are adapted for respectively extending through the loops; and when said reed unit is in the stacked state, said first and second reeds are stacked together, and said first reed teeth respectively mate with said second reed teeth; and when said reed unit is transformed from the expanded state to the staked state, each of said loop holding units holds at least one of two adjacent ones of the loops that are positioned closest to and symmetrical about a respective one of the line intersects, so as to retain said at least one of the two adjacent ones of the loops on a corresponding one of said first and second reed teeth.

2. The loop joining apparatus as claimed in claim 1, wherein each of said loop holding units includes a holding member that has a retaining end portion, and that is operable to move between a holding position, where said retaining end portion is adapted to hold said at least one of the two adjacent ones of the loops so as to retain said at least one of the two adjacent ones of the loops on the corresponding one of said first and second reed teeth, and a non-holding position, where said retaining end portion of said holding member is spaced apart from said reed unit, and releases said at least one of the two adjacent ones of the loops.

3. The loop joining apparatus as claimed in claim 2, wherein said second reed is pivotable about the folding axis relative to said first reed so as to permit said reed unit to transform between the expanded state and the stacked state, said retaining end portion of said holding member of each of said loop holding units being adapted to hold a selected one of the two adjacent ones of the loops that are positioned closest to a corresponding one of the line intersects, so as to retain said selected one of the two adjacent ones of the loops on the corresponding one of said first reed teeth.

4. The loop joining apparatus as claimed in claim 2, wherein said retaining end portion of said holding member of each of said loop holding units is adapted to hold an interconnecting section that interconnects the two adjacent ones of the loops, such that the two adjacent ones of the loops are respectively retained on the corresponding ones of said first and second reed teeth.

5. The loop joining apparatus as claimed in claim 2, wherein each of said loop holding units further includes a driving member for driving said holding member of a corresponding one of said loop holding units to move between the holding position and the non-holding position.

6. The loop joining apparatus as claimed in claim 5, wherein:

said holding member of each of said loop holding units further has a pivot end portion that is opposite to said retaining end portion, and a middle portion that interconnects said pivot end portion and said retaining end portion; and each of said loop holding units further includes a stationary platform that permits said pivot end portion of said holding member to be pivoted thereto, and a linking member that extends movably through said stationary platform, and that has a first end pivoted to said middle portion of said holding member, and a second end opposite to said first end and pivoted to said driving member, such that said driving member is operable to drive said holding member to move between the holding position and the non-holding position through said linking member.

7. The loop joining apparatus as claimed in claim 6, wherein said linking member is L-shaped.

8. The loop joining apparatus as claimed in claim 2, wherein said retaining end portion of said holding member is configured as a hook.

9. The loop joining apparatus as claimed in claim 2, wherein said retaining end portion of said holding member is configured as a brush.

10. The loop joining apparatus as claimed in claim 2, wherein said retaining end portion of said holding member is configured as an air nozzle.

11. A method for joining loops of an open end of a tubular knitted article to close the open end, the loops of the open end surrounding a central axis, the method comprising the steps of:

(1) extending respectively first and second reed teeth of first and second reeds of a reed unit through the loops when the reed unit is in an expanded state;

(2) retaining at least one of two adjacent ones of the loops that are positioned closest to and symmetrical about one of two line intersects of the reed unit and a folding axis about which the first and second reeds are pivotable relative to each other on a corresponding one of the first and second reed teeth, and retaining at least one of two adjacent ones of the loops that are positioned closest to and symmetrical about the other one of the two line intersects on another corresponding one of the first and second reed teeth; and (3) transforming the reed unit from the expanded state to a stacked state, so that the first and second reeds are stacked together, and the first reed teeth respectively mate with the second reed teeth.

12. The method as claimed in claim 11, wherein, in step (2), for each of the line intersects, a selected one of the two adjacent ones of the loops that are positioned closest to a corresponding one of the line intersects, is held and retained on the corresponding one of the first reed teeth.

13. The method as claimed in claim 11, wherein, in step (2), for each of the line intersects, an interconnecting section that interconnects the two adjacent ones of the loops is held, so as to retain the two adjacent ones of the loops on the corresponding ones of the first and second reed teeth.

* * * * *